US008262085B2

(12) United States Patent
Feygelman

(10) Patent No.: US 8,262,085 B2
(45) Date of Patent: Sep. 11, 2012

(54) DECURLER AND STABILIZER FOR LIGHT-WEIGHT PAPERS

(75) Inventor: Alex Feygelman, Ness Ziona Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 1411 days.

(21) Appl. No.: 10/555,032

(22) PCT Filed: Apr. 30, 2003

(86) PCT No.: PCT/IL03/00351

§ 371 (c)(1), (2), (4) Date: Apr. 8, 2008

(87) PCT Pub. No.: WO2004/096562

PCT Pub. Date: Nov. 11, 2004

(65) Prior Publication Data

US 2008/0224383 A1 Sep. 18, 2008

(51) Int. Cl.
*B65H 29/70* (2006.01)

(52) U.S. Cl. ..... 271/209; 271/188

(58) Field of Classification Search ..... 271/209, 271/213, 188; 399/406

See application file for complete search history.

(56) References Cited

U.S. PATENT DOCUMENTS

| | | | | |
|---|---|---|---|---|
| 2,827,287 | A | 3/1958 | Gross et al. | |
| 3,240,490 | A * | 3/1966 | Fairbanks et al. | 271/188 |
| 3,828,998 | A | 8/1974 | Gross | |
| 3,937,458 | A | 2/1976 | Langen | |
| 4,794,859 | A * | 1/1989 | Huseby et al. | 101/485 |
| 5,033,731 | A * | 7/1991 | Looney | 271/176 |
| 5,381,267 | A | 1/1995 | Woody | |
| 5,414,503 | A | 5/1995 | Siegel et al. | |
| 5,450,102 | A | 9/1995 | Ishida et al. | |
| 5,539,511 | A | 7/1996 | Wenthe, Jr. et al. | |
| 5,625,398 | A | 4/1997 | Milkovits et al. | |
| 5,717,836 | A | 2/1998 | Horie | |
| 5,884,860 | A | 3/1999 | Ishikawa et al. | |
| 6,238,114 | B1 * | 5/2001 | Bennett et al. | 400/625 |

FOREIGN PATENT DOCUMENTS

| | | |
|---|---|---|
| EP | 1013456 | 6/2000 |
| EP | 1288152 | 3/2003 |
| JP | 56-061266 | 5/1981 |
| JP | 01-321251 | 12/1989 |
| JP | 06100226 A * | 4/1994 |
| JP | 6-33859 | 5/1994 |
| JP | 06-329327 | 11/1994 |
| JP | 09-002717 | 1/1997 |
| JP | 2001-031312 | 2/2001 |
| JP | 2002-104705 | 4/2002 |
| JP | 2003-118915 | 4/2003 |

* cited by examiner

*Primary Examiner* — Luis A Gonzalez

(57) ABSTRACT

A decurler to decurl a curled printing media being transported into a release area, the decurler comprising: a) at least one guide arm against which the printing media presses, positioned and adapted to bend the printing media along an axis substantially in a direction of transport thereof; and b) a hinge on which the guide arm is mounted, the hinge being oriented at an angle of between 0.25 degrees and 20 degrees from vertical, wherein a reaction force that the guide arm exerts on the printing media is suitable for decurling the printing media. Another decurler with a flexible strip which hangs down and presses against a middle portion of the printing media.

28 Claims, 7 Drawing Sheets

DECURLER AND STABILIZER FOR LIGHT-WEIGHT PAPERS

CROSS-REFERENCE TO RELATED APPLICATIONS

This application incorporates by this reference all subject matter contained in PCT Patent Application Serial No. PCT/IL2003/000351, as filed on 30 Apr. 2003, and entitled "Decurler and Stabilizer for Light-Weight Papers". This PCT application was published on 11 Nov. 2004 as International Publication No. WO 2004/096562 A1.

FIELD OF THE INVENTION

The field of the invention is printers and copiers, and particularly decurling mechanisms.

BACKGROUND OF THE INVENTION

Handling of paper and other printing media in printers and copiers often involves having the paper travel with or around a roller. This generally occurs, for example, in printing an image on paper using an impression roller, especially for heated printing, as well as in some systems flipping paper over before printing a second side, or in flipping over a two-sided original page that is being copied, and in some systems conveying paper from an input tray to an output tray. Because paper tends to retain its curl to some extent after it is passed around a roller, printers and copiers use various methods of decurling paper, so that the final printed page, as well as the original paper being copied in a copier, is flat. U.S. Pat. No. 5,450,102, to Ishida et al, describes a decurling mechanism for a printer in which paper is decurled by bending it around a roller in the opposite direction from the direction in which it acquired its curl, but along the same axis.

Other printers decurl paper by bending it along an axis orthogonal to the original axis along which it was curled. For example, guides, mounted on walls to the sides of the paper, press against the paper from the sides, bending the paper as it falls into an output area. In some printers, the reaction force of the paper on the guides pushes the guides out of the way, thereby limiting the force that the guides exert on the paper. In some of these printers, there are counter-weights on the guides, so that the guides swing back up, to press against the next sheet of paper, after the paper falls into the output area. If the counter-weights nearly balance the weight of the guides, then the force required to push the guides out of the way is very small, and the guides exert only a very small force to bend the paper. Such an arrangement may be advantageous particularly when the paper is very light-weight and bends easily. However, the counter-weights take up room.

SUMMARY OF THE INVENTION

An aspect of an embodiment of the invention concerns a decurler with guides which push against the sides of a paper, bending it along an axis orthogonal to the axis along which it acquired its curl, thereby decurling it. In some embodiments of the invention, this decurling occurs as the paper is falling into an output area, for example an output tray, or an area from which the paper is conveyed to another location for further printing or processing. The guides are dynamic guides, pushed out of the way by the paper, and swinging back when the paper has passed, so that the guides are in position to decurl the next paper. Instead of using counter-weights as in some of the prior art, the dynamic guides are mounted on hinges which have an axis that is oriented at an angle slightly different from vertical. This arrangement takes up less space and has fewer parts than guides which use counter-weights. Because the hinges are nearly vertical, only a small force is needed to push the dynamic guides out of the way, so the guides exert only a small force on the paper when bending it. The guides can be pushed out of the way by a force that is approximately equal to the weight of each guide, times the angle that the hinge is oriented away from vertical. The low force of the dynamic guides is suitable for decurling light-weight paper. The best angle to use for the axis of the hinge depends on the length and shape of the guide and on the weight, dimensions and composition of the paper or other printing media, and is optionally determined experimentally.

An aspect of some embodiments of the invention concerns a strip which is attached at one end to a wall above the back of an output area where paper is dropped. The other end of the strip hangs down into the path of the paper. As the paper is brought from the back of the output area into a position above the output area, the paper lifts up the free end of the strip. As a trailing portion of the paper starts to fall down towards the output area, and especially when a leading portion of the paper is released, for example by releasing a suction system, the free end of the strip pushes down against the trailing portion of the paper, pushing the paper down to the output area. This prevents a problem, which can occur with light-weight paper, that the paper floats down too slowly and has time to become folded over as it falls, for example due to air currents.

Optionally, there are guides, and the hanging strip pushes the paper against the guides, to decurl the paper. Optionally, the guides are dynamic guides, optionally mounted on hinges at a small angle away from the vertical, so that the guides move out of the way easily. Then the hanging strip can push the paper down with more force, without the strip tearing the paper or bending it too sharply. In some embodiments of the invention and for some grades of paper, the extra force exerted on the paper by the strip, beyond the weight of the paper, is optimal for decurling the paper. The hanging strip and the off-vertical hinged dynamic guides thus work particularly well when used together, but they can also be used separately.

There is thus provided, in accordance with an embodiment of the invention, a decurler to decurl a curled printing media being transported into a release area, the decurler comprising:

a) at least one guide arm against which the printing media presses, positioned and adapted to bend the printing media along an axis substantially in a direction of transport thereof; and b) a hinge on which the guide arm is mounted, the hinge being oriented at an angle of between 0.25 degrees and 20 degrees from vertical, wherein a reaction force that the guide arm exerts on the printing media is suitable for decurling the printing media.

Optionally, the guide arm is mounted so that it remains in an equilibrium position to receive the printing media when there is no force on the guide arm, but the guide arm swings on the hinge away from the equilibrium position when the printing media presses vertically on the guide arm.

In an embodiment of the invention there is a second guide arm, and the two guide arms exert substantially equal forces on the printing media on opposite edges thereof, thereby bending it.

Optionally, the two guide arms are substantially mirror images of each other.

Optionally, the force that the guide arm exerts on the printing media is exerting on a trailing portion of the printing media.

Optionally, the guide arm includes a substantially flat contact surface, and the printing media presses against the contact surface when it presses against the guide arm.

In an embodiment of the invention, the guide arm is at least twice as long along a longest axis thereof as it is wide across any axis perpendicular to the longest axis.

Optionally, the guide arm is at least five times as long along the longest axis thereof as it is wide across any axis perpendicular to the longest axis.

Optionally, the longest axis is oriented at an angle to the vertical, for any position of the guide arm as it swings on the hinge.

Optionally, the angle of orientation of the long axis to the vertical is between 20 and 50 degrees, for any position of the guide arm as it swings on the hinge.

Optionally, the surface of the guide arm is smooth enough where the printing media presses against said surface so that the guide arm does not abrade the printing media.

Optionally, the guide arm has an L-shaped cross-section transverse to its longest axis.

In an embodiment of the invention, the hinge comprises an upper socket, an upper pin which fits into the upper socket, a lower socket, and a lower pin which fits into the lower socket, and the upper and lower pins are substantially collinear, and oriented at the angle from the vertical at which the hinge is oriented.

Alternatively, the hinge comprises an upper socket, an upper pin which fits into the upper socket, a lower socket, and a lower pin which fits into the lower socket, and the upper and lower pins are oriented substantially vertically, and displaced laterally from each other by a distance such that a line passing through both pins is oriented at the angle from the vertical at which the hinge in oriented.

Optionally, the angle from the vertical at which the hinge is oriented is less than or equal to 1 degree.

Alternatively, the angle from the vertical at which the hinge is oriented is between 1 and 2 degrees.

Alternatively, the angle from the vertical at which the hinge is oriented is between 2 and 5 degrees.

Alternatively, the angle from the vertical at which the hinge is oriented is greater than 5 degrees.

Optionally, the guide arm is less than or equal to 40 mm long in its longest dimension.

Alternatively, the guide arm is between 40 mm and 80 mm long in its longest dimension.

Alternatively, the guide arm is between 80 and 120 mm long in its longest dimension.

Alternatively, the guide arm is greater than 120 mm long in its longest dimension.

Optionally, the guide arm has a mass less than or equal to 1 gram.

Alternatively, the guide arm has a mass between 1 and 2 grams.

Alternatively, the guide arm has a mass between 2 and 5 grams.

Alternatively, the guide arm has a mass between 5 and 10 grams.

Alternatively, the guide arm has a mass between 10 and 20 grams.

Alternatively, the guide arm has a mass greater than 20 grams.

Optionally, the guide arm can swing on its axis only over a limited range that does not include a position at which the guide arm has a local minimum in gravitational potential energy.

Optionally, there is a flexible strip which hangs down and pushes against a middle portion of the printing media as it moves in the feed direction, causing the printing media to bend along an axis substantially parallel to the direction of transport.

There is thus also provided, in accordance with an embodiment of the invention, a decurler to decurl a curled printing media as it moves in a direction of transport toward a release area in a printer or copier, comprising a flexible strip which hangs down and pushes against a middle portion of the printing media as it moves in the feed direction, causing the printing media to bend along an axis substantially parallel to the direction of transport.

Optionally, the strip pushes against a trailing portion of the printing media.

Optionally, there is at least one other strip which hangs down and pushes against the middle portion of the printing media as it moves in the direction of transport, causing the printing media to bend along an axis substantially parallel to the direction of transport.

Optionally, the strip has a thickness between 0.05 mm and 0.15 mm.

Alternatively, the strip has a thickness between 0.15 mm and 0.25 mm.

Alternatively, the strip has a thickness between 0.25 mm and 0.8 mm.

Optionally, the strip has a width between 3 mm and 8 mm.

Alternatively, the strip has a width between 8 mm and 16 mm.

Alternatively, the strip has a width between 16 mm and 40 mm.

In an embodiment of the invention, the strip is made of steel.

Optionally, the strip is made of spring stainless steel.

Alternatively, the strip is made of tempered tool steel.

There is thus further provided, in accordance with an embodiment of the invention, a printer or copier for printing an image on a printing media, comprising:

a) a roller which imparts a curl to the printing media;
b) a release area;
c) a transport mechanism which transports the printing media from the roller to the release area; and
d) a decurler according to the invention, which decurls the printing media as it is transported into the release area.

Optionally, the transport mechanism comprises at least one suction arm with a suction cup at its end, which at least one suction arm picks up the printing media from a pick-up position above the release area, swings the paper to a release position above the release area, and releases the paper at the release position so that it falls into the release area.

Optionally, the at least one suction arms passes to one side of each of the at least one strips as the at least one suction arms swing around.

BRIEF DESCRIPTION OF THE DRAWINGS

Exemplary embodiments of the invention are described in the following sections with reference to the drawings. The drawings are generally not to scale and the same or similar reference numbers are used for the same or related features on different drawings.

DETAILED DESCRIPTION OF EXEMPLARY EMBODIMENTS

Figure 1A:
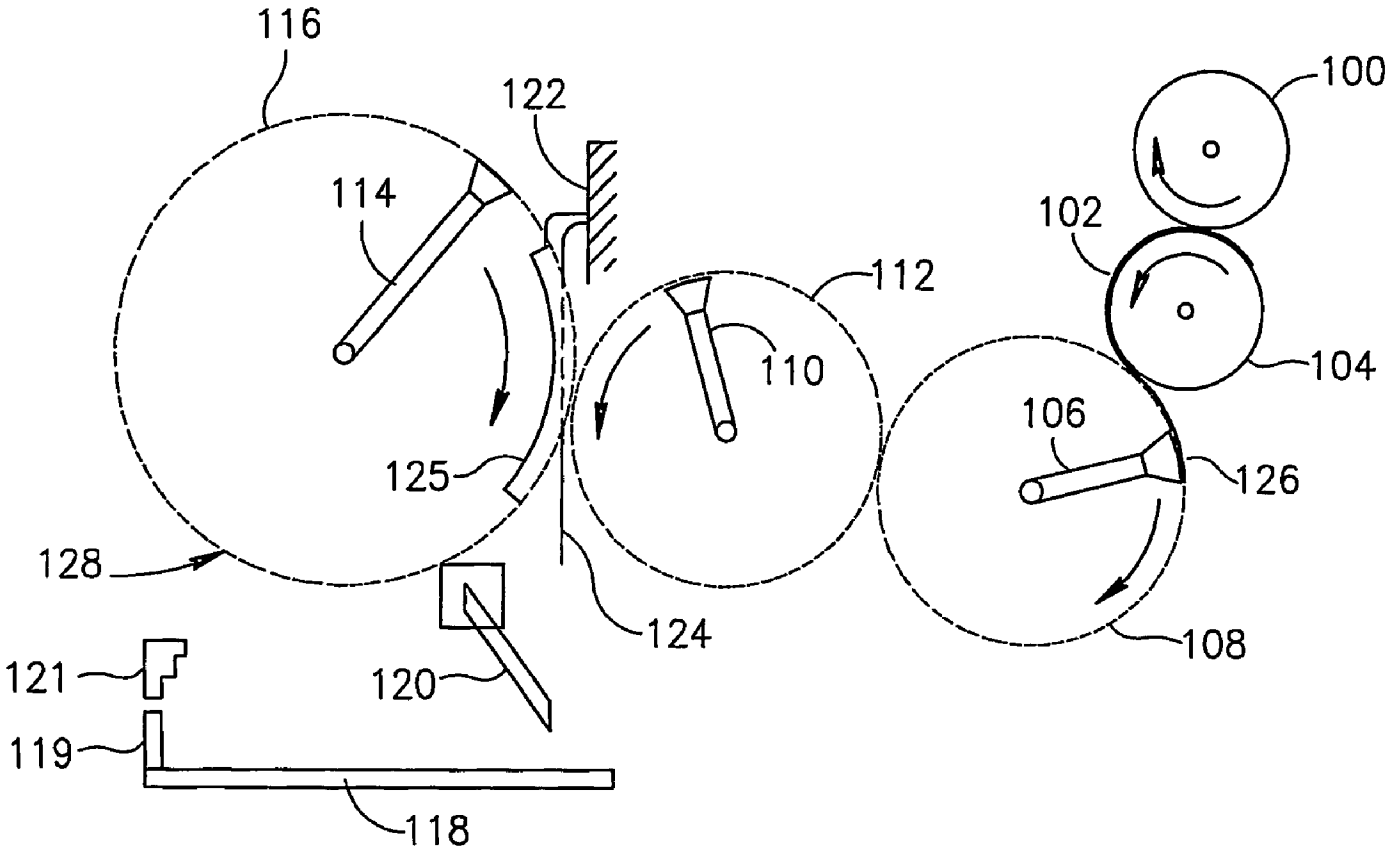
FIG. 1A is a side cross-sectional view of a printer, showing a paper receiving an image on an impression roller, according to an exemplary embodiment of the invention.

FIG. 1A, a cross-sectional view of a printer seen from the side, shows an intermediate transfer member 100 imprinting an image on a paper 102 pressed against an impression roller 104. The heat and pressure exerted on paper 102 by intermediate transfer member 100 imparts a curl to paper 102, in the same direction as the surface of impression roller 104. A suction arm 106 rotates, with its end following a circular path 108. At the time shown in FIG. 1A, suction arm 106 has just pulled a leading portion of paper 102 off roller 104, and has started to swing paper 102 in a clockwise direction around circular path 108.

In addition to suction arm 106, there is also a second suction arm 110, which picks up the paper from suction arm 106, and which rotates counter-clockwise at the same angular rate as suction arm 106, and whose end follows a circular path 112. Finally, there is a third suction arm 114, which picks up the paper from suction arm 110, and which rotates clockwise at the same angular rate as suction arms 106 and 110, and whose end follows circular path 116. Suction arm 114 drops paper 102 into an output area 118. Optionally, output area 118 is an output tray. Alternatively, paper is conveyed from output area 118 to another location for further processing, for example for printing the other side of the paper.

FIG. 1A also shows a decurler 120, a wall 122, a strip 124 and a rotational guide 125. These parts and their function are described below. Alternatively, one or more of decurler 120, strip 124 or rotational guide 125 are not present. Alternatively decurler 120 is a decurler according to the prior art.

Optionally, the three suction arms do not all rotate at the same angular rate. However, if their rotation rates at least have ratios that are the ratios of small integers, then the suction arms will periodically align at the proper points for transferring the paper from one suction arm to another. In a particular example of the invention, the ratios of the diameters of rollers 104, circle 108, circle 112 and circle 116 is 1:2:2:3.

Generally, each suction arm shown in the drawing represents a plurality of suction arms lined up in a direction normal to the plane of the drawing. Optionally, one or two of the suction arms shown in FIG. 1A are not present, and the paper is transferred directly from the impression roller to suction arm 114, for example. However, having three suction arms, or three sets of suction arms, as shown in FIG. 1A, gives the paper time to cool off, and the ink time to dry, before the paper reaches the output area. Optionally, there are even more than three suction arms or sets of suction arms. Optionally, the operator has easy access to the paper path between impression roller 104 and output area 118, and can visually check the printed images before the paper reaches output area 118.

Optionally, instead of one or more of the suction arms shown in FIG. 1A, there is a roller whose cross-section fills up the interior of the corresponding circular path, or part of the interior. If one of the suction arms is replaced by a roller, then optionally there is still a suction system holding the paper to that roller. Alternatively or additionally, there are grippers holding the paper to that roller. Optionally, even if there are suction arms rather than rollers, there are circular rims at one or both edges of the paper, and/or at one or more locations in the middle of the paper, which guide the paper to follow one or more of the circular paths. PCT publications WO 01/34397 and WO 01/56802 describe examples of using rollers for transporting paper.

Figure 1B:
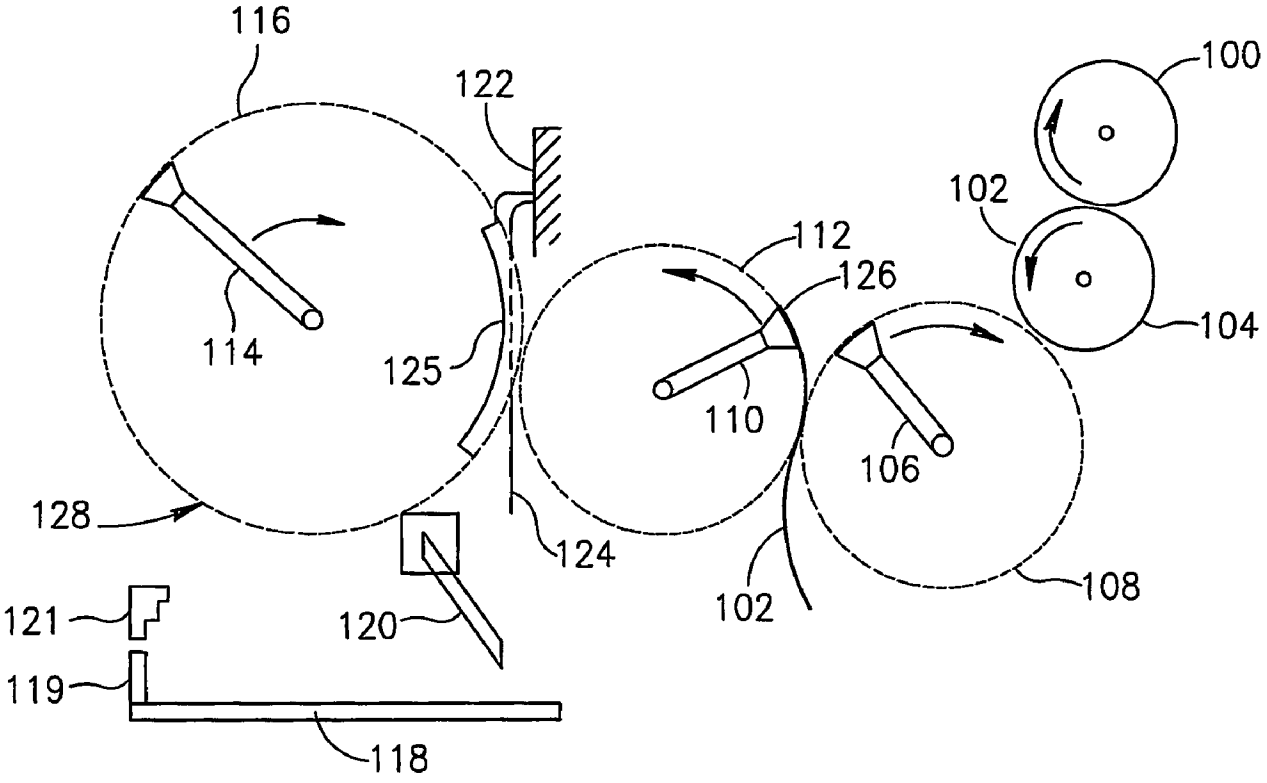
FIGS. 1B, 1C, and 1D show the paper at three successive times after the time of FIG. 1A, as the paper is transported to an output area, according to the same embodiment of the invention as FIG. 1A.

FIG. 1B shows suction arms 106, 110 and 114 about three-quarters of a turn later. Suction arm 110 has just passed suction arm 106, and has picked up a leading portion 126 of paper 102 from suction arm 106, and started to swing the leading portion of paper 102 around circular path 112.

Figure 1C:
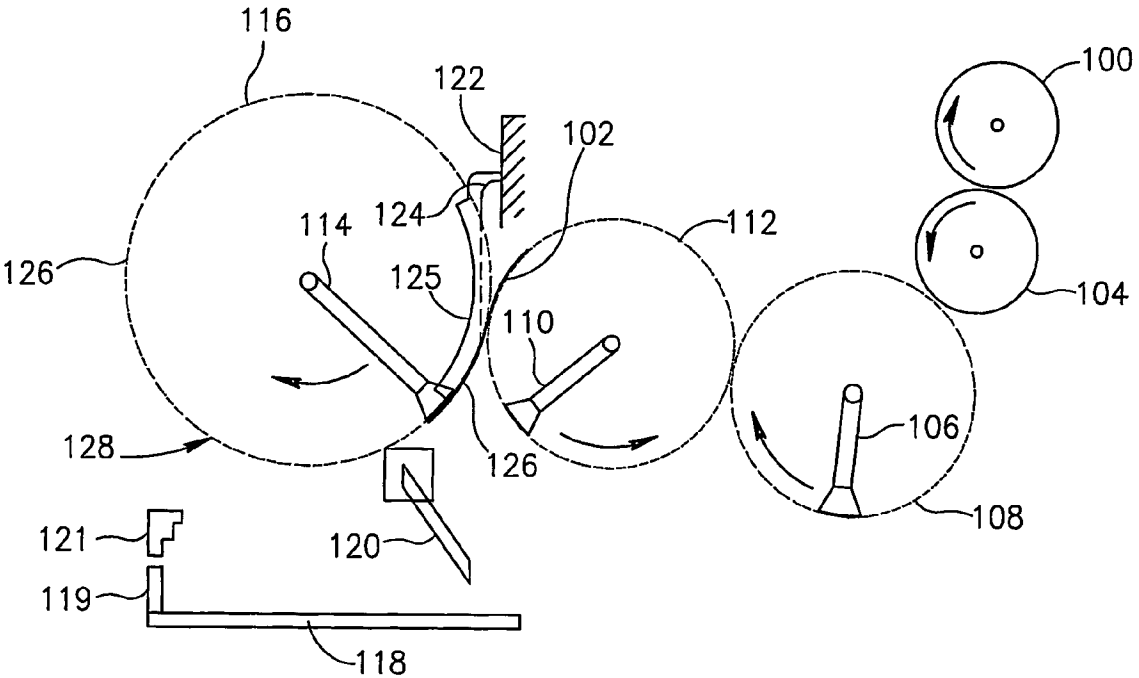

FIG. 1C shows suction arms 106, 110, and 114 about two-thirds of a turn after the time of FIG. 1B. Arms 110 and 114 have just passed each other, and leading portion 126 of paper 102 has been transferred from arm 110 to arm 114, which starts to swing the leading portion of the paper around circular path 116. As indicated above, the mechanism optionally includes strip 124, and rotational guide 125 attached to wall 122.

Although it looks in FIG. 1C as if strip 124 is interposed between suction arm 114 and paper 102, and strip 124 interferes with rotational guide 125, in fact the strip, the rotational guide, and suction arm 114 are in different planes parallel to the plane of the drawing. All three elements are directly in contact with the paper, at different positions along the width of the paper. Optionally, as noted above, there are a plurality of arms 114 aligned across the width of paper 102, and in this case, strip 124 and rotational guide 125 are between two of them. Optionally, there are also a plurality of strips 124 and rotational guides 125, which, for example, alternate across a part of the width of paper 102 with the plurality of arms 114. The function of rotational guide 125 is to control the curvature of the paper as it moves along circle 116. The function of the strips is described below, after the description of FIG. 4.

Figure 1D:
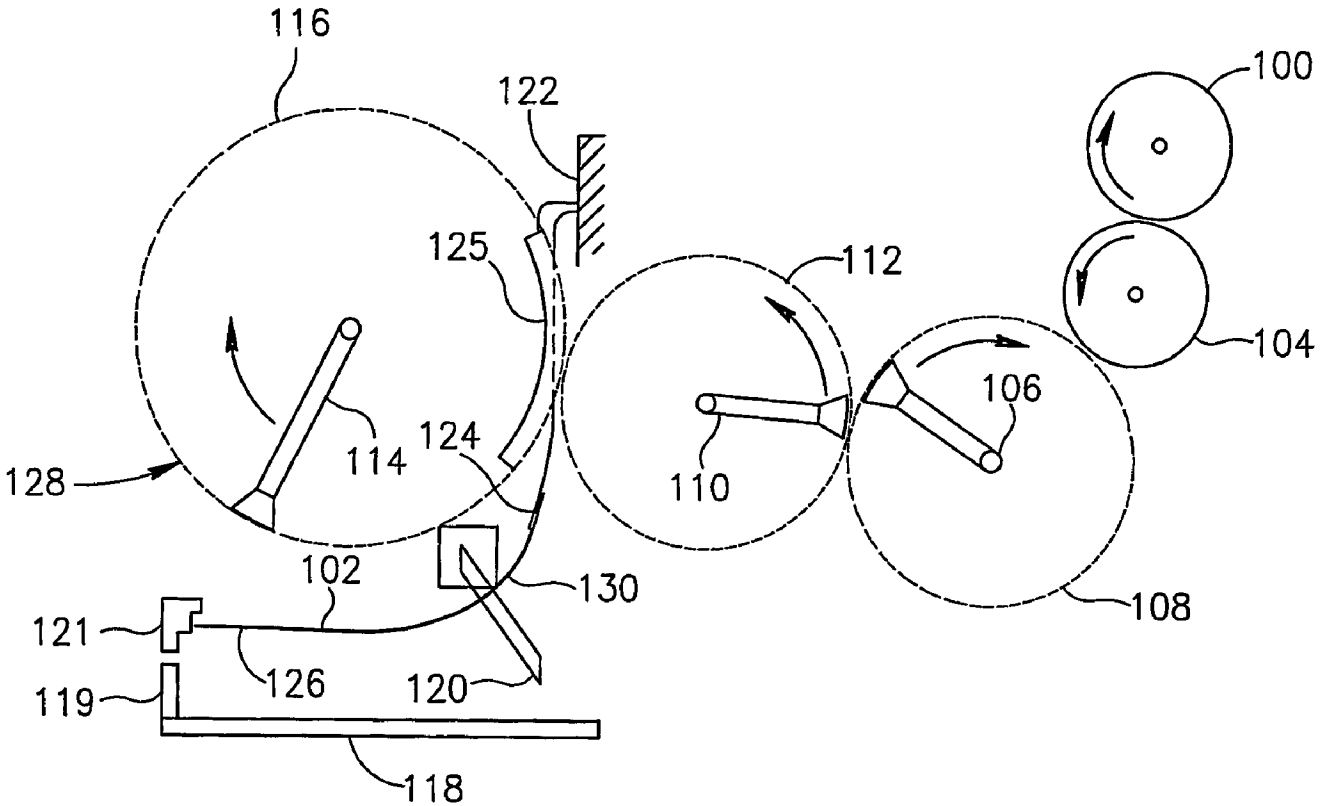

FIG. 1D shows suction arms 106, 110 and 114 about half of a turn later. When suction arm 114 passes point 128, shortly before the time shown in FIG. 1D, suction arm 114 lets go of the leading portion of paper 102. At the time shown in FIG. 1D, paper 102 has started to fall down toward output area 118. Paper 102 still has the curl imparted to it by impression roller 104, and this is visible in the leading portion 126 of paper 102, which is curled downward. As paper 102 falls, a trailing portion 130 of paper 102 goes past decurler 120, which bends the sides of the paper upward, along an axis in the plane of the drawing, which is orthogonal to the axis (normal to the plane of the drawing) along which the paper is curled.

Optionally, the paper hits a paper stop 121 and falls into tray 118, where it is pushed against alignment stop 119. The construction of a preferred embodiment of this part of the system is described in more detail in a concurrently filed PCT application entitled "Paper Stop", the disclosure of which is incorporated by reference. Alternatively, a paper tray and stop according to the prior art can be used.

Figure 2:
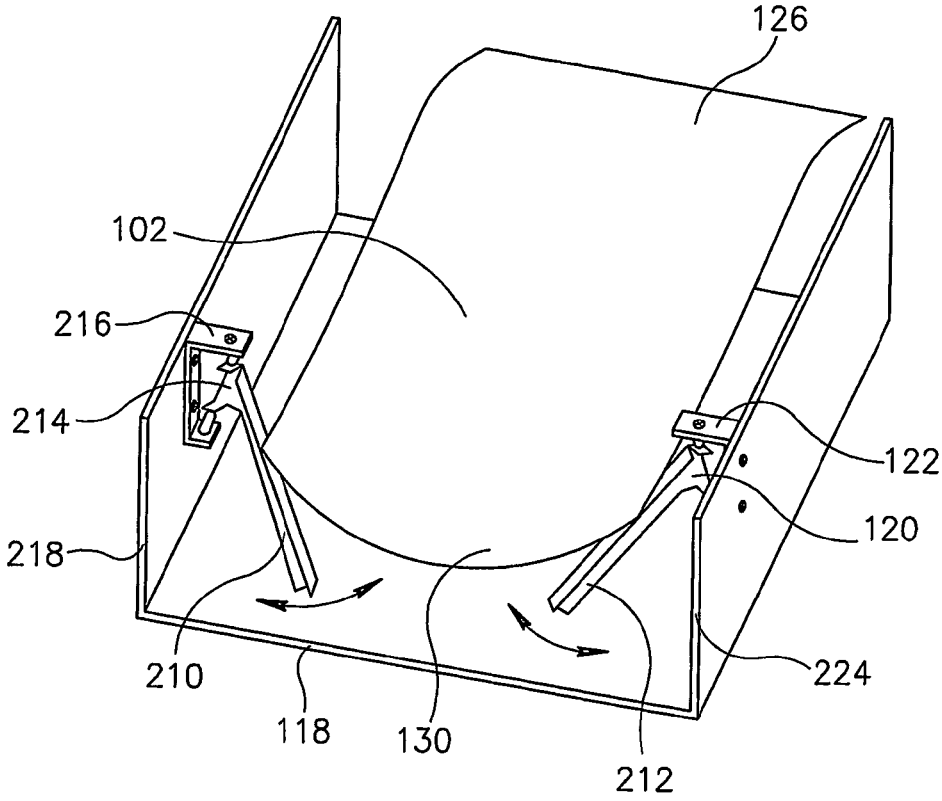
FIG. 2 is a perspective view of the paper and output area shown in FIG. 1D, also showing a decurler.

FIG. 2 is a perspective view of the same scene as shown in FIG. 1D, looking somewhat downward toward falling paper 102, output area 118, and decurler 120, from a point of view near the bottom of circular path 112. Note that leading portion 126 of paper 102 still shows the curl of the paper acquired from roller 104 in FIG. 1A. For clarity, suction arm or arms 114, and strip 124, are not shown. Decurler 120 includes dynamic guides 210 and 212, one on each side of output area 118. As paper 102 falls toward output area 118, the sides of trailing portion 130 of the paper press against dynamic guides 210 and 212, which project into the space beneath paper 102, causing trailing portion 130 to bend along an axis orthogonal to the axis of the curl which paper 102 acquired from impression roller 104, and in a direction opposite to the direction of the curl. This bending causes the paper to decurl, while falling into output area 118.

In an embodiment of the invention, dynamic guide 210 has a hinge 214, which is mounted on a bracket 216, which is attached to a wall 218 on one side of output area 118. Similarly, dynamic guide 212 has a hinge 220 which is mounted on bracket 222, attached to a wall 224 on the side of output area 118 opposite to wall 218. Hinges 214 and 220 both have axes that are displaced by a small angle from the vertical. The angle is exaggerated in FIG. 2, as well as in FIGS. 3 and 4, for clarity.

When paper 102 presses against dynamic guides 210 and 212, they swing on their hinges toward the walls they are mounted on, moving away from each other and allowing paper 102 to fall into output area 118. Because of the tilt of the axis of hinge 214 and hinge 220, dynamic guides 210 and 212 swing back away from walls 218 and 224, towards the center of output area 118, after paper 102 has fallen down and no longer presses against them, ready to receive the next paper. Because the hinge axes are tilted at only a small angle, little force is required to push dynamic guides 210 and 212 away. Thus, dynamic guides 210 and 212 exert only a small reaction force on paper 102. This small force is appropriate for decurling a very light-weight paper.

Optionally, there is only one dynamic guide, which presses against only one side of paper 102, bending it and decurling it. Optionally, in this case, an opposing force on the other side of paper 102 is provided by inertia, or friction, or by paper 102 leaning against the wall, or a fixed guide, on the other side. However, using two dynamic guides symmetrically arranged, as shown in FIG. 2, has the potential advantage of allowing the paper to stack more evenly, preventing paper jams.

Figure 3:
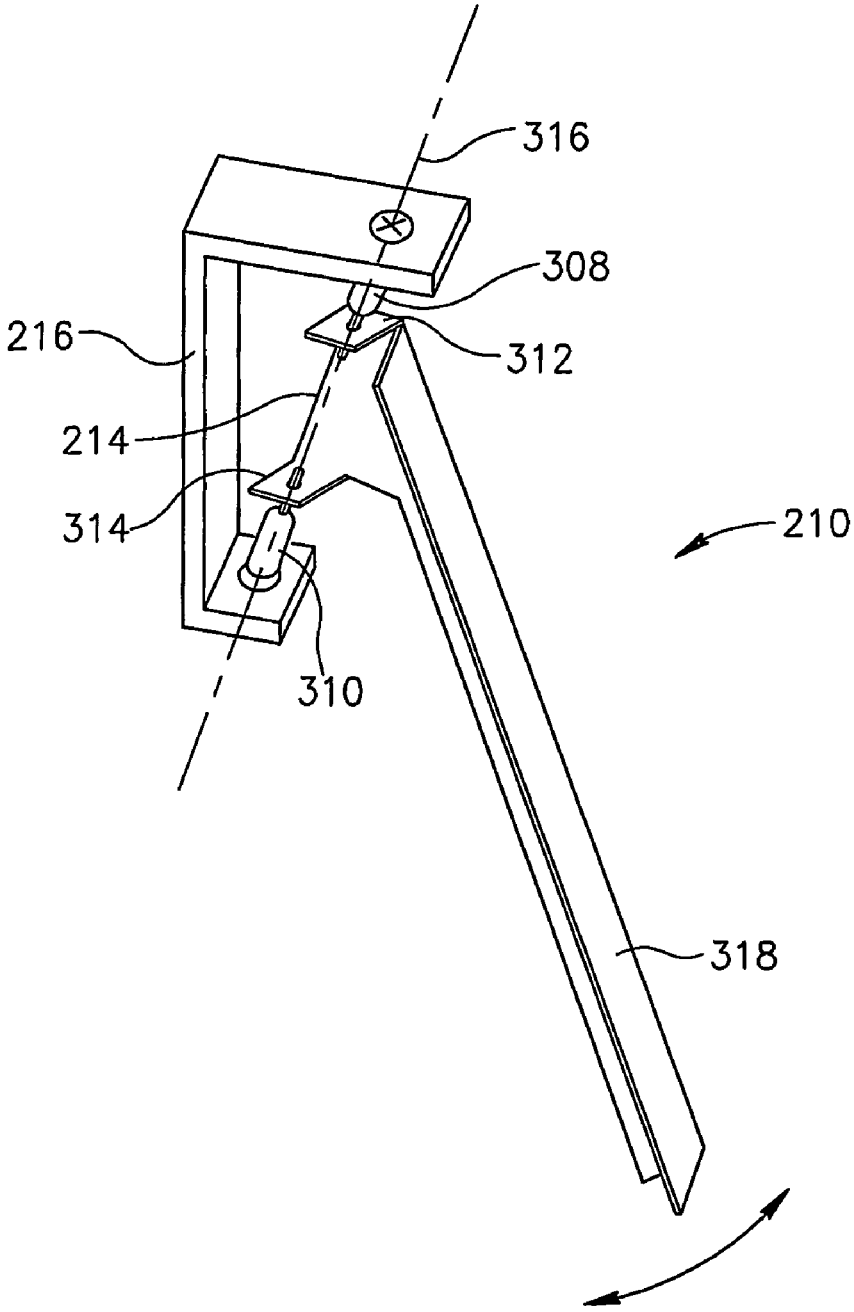
FIG. 3 is a perspective view of a dynamic guide with a hinge mounted on a bracket, according to an embodiment of the invention.

FIG. 3 is a closer view showing an embodiment of dynamic guide 210 with hinge 214 mounted in bracket 216. Bracket 216 has an upper pin 308 and lower pin 310 which fit respectively into an upper pin holder 312 and lower pin holder 314 on hinge 214. Alternatively, one or both of the pins are part of hinge 214, and the corresponding one or both pin holders are part of bracket 216. Alternatively, the hinge and bracket are joined in any other way that allows the hinge to swing.

In the embodiment of FIG. 3, the axis 316 of pins 308 and 310 is not oriented vertically, but at a small angle to the vertical, for example about 2 degrees. The angle shown in FIG. 3 is exaggerated, for clarity. Alternatively, axis 316 is oriented at about 0.5 degrees to the vertical, or at about 1 degree, or at about 3 degrees, or at about 5 degrees, or at about 10 degrees, or at any smaller, intermediate, or larger angle. The best angle to use for axis 316 depends on the length and shape of the guide and on the weight, dimensions and composition of the paper or other printing media, and is optionally determined experimentally.

The horizontal force needed (in a direction normal to the wall) to push dynamic guide 210 toward the wall is approximately equal to the weight of dynamic guide 210 times the small angle that axis 316 makes to the vertical, and this force is approximately independent of the position of dynamic guide 210 as it swings around axis 316. Thus, there is an upper limit to how much horizontal force dynamic guides 210 and 212 exert on the paper, as the paper falls to the output area. For example, if each dynamic guide has a mass of about 5 grams, and hence a weight of about 0.05 newtons, and if each axis 316 is oriented at an angle of about 2 degrees (about 1/30 of a radian) from vertical, then the dynamic guides will not exert a force of more than about 0.0017 newtons from each side, about 1/30 of their weight. This calculation neglects the inertia of the dynamic guides, but if the dynamic guides are accelerating to the sides at much less than 0.3 $m/s^2$, then the inertial force can be neglected. Alternatively, the mass of each of dynamic guides 210 and 212 is about 1 gram, or 2 grams, or 10 grams, or 20 grams, or 50 grams, or less than 1 gram, or more than 50 grams, or any intermediate mass. The optimum mass to use for a given weight of paper or other printing media is optionally determined experimentally. Although the two dynamic guides need not have the same mass, using mirror image guides of the same mass and shape will result in symmetric forces being exerted on the paper from both sides, which has the potential advantage of allowing the paper to stack more evenly, avoiding paper jams.

Figure 4:
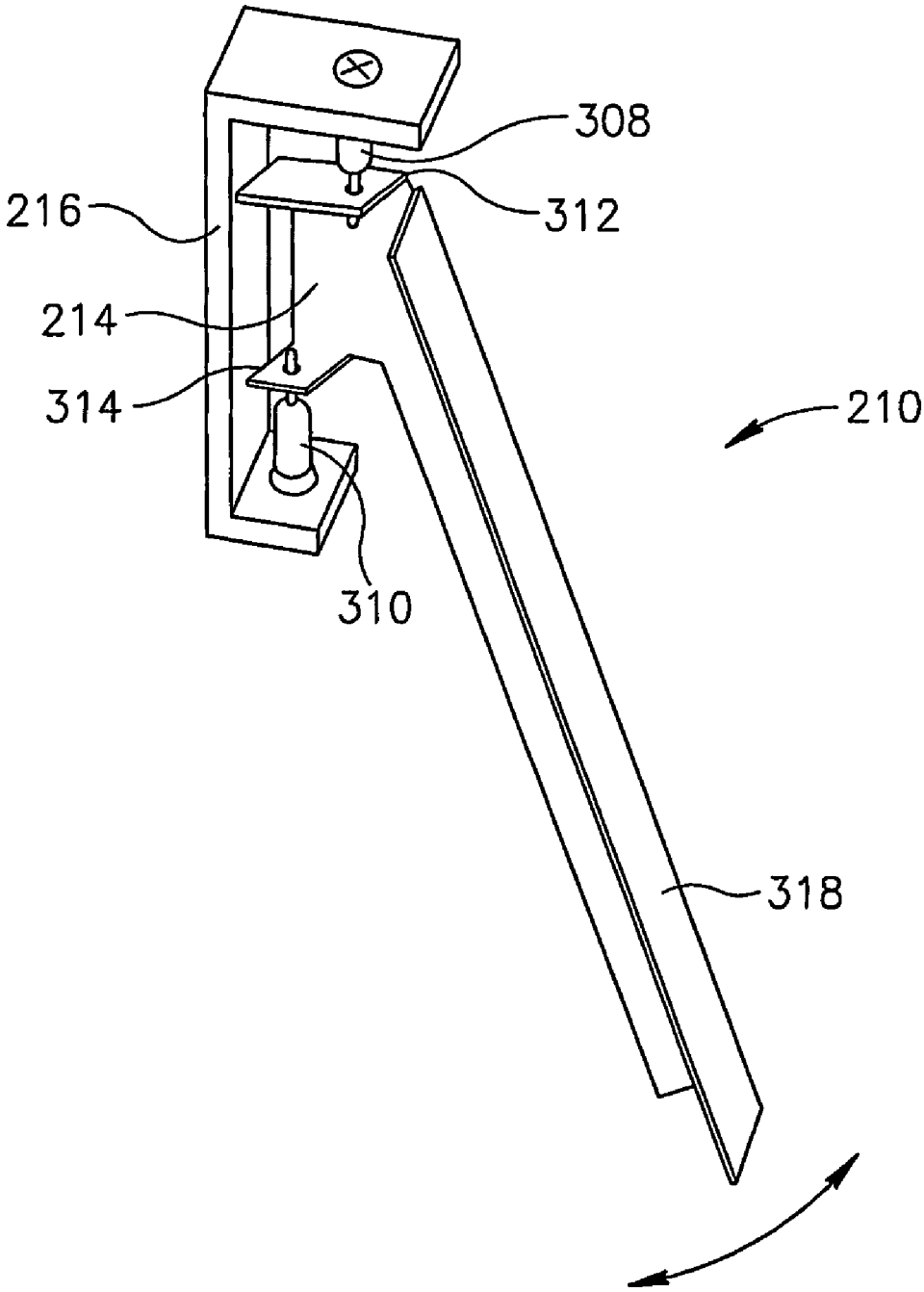
FIG. 4 is a perspective view of a dynamic guide with a hinge mounted on a bracket, according to another exemplary embodiment of the invention.

Optionally, instead of pins 308 and 310 being coaxial with axis 316 which is oriented obliquely, upper pin 308 and lower pin 310 are each oriented vertically, but they are displaced slightly from each other laterally, and the same is true of pin holders 312 and 314. This is shown in FIG. 4, where the lateral displacement between the upper and lower pins is exaggerated, for clarity. When there are two dynamic guides as in FIG. 2, this configuration is optionally used for one or both dynamic guides. As long as the pins do not fit too snugly into the pin holders, then dynamic guide 210 will be free to swing back and forth, although, as it swings, the upper and lower pins will not remain vertical, but will be forced to tilt. Depending on how loose the fit is between the pins and the pin holders, the pins may start to rub against the pin holders as they tilt, limiting the motion of dynamic guide 210. Optionally, the fit between the pins and the pin holders is chosen so that dynamic guide 210 has a limited range of motion, or so that a higher force is required to move dynamic guide 210 past a certain angle. If the pins and pin holders are fit loosely enough so that they do not rub at a given angle of dynamic guide 210, then the force required to move dynamic guide 210 towards the wall with the configuration of FIG. 4 is approximately the same as it would be with the configuration of FIG. 3, when a line passing through pins 308 and 310 makes the same angle to the vertical.

Alternatively or additionally, a stop, not shown in FIG. 3 or 4, is used to prevent dynamic guide 210 from moving past a certain angle, in either FIG. 3 or FIG. 4. The allowed range of motion of dynamic guide 210 affects the properties of the decurler (as do its mass and the tilt of its axis), because it affects how much the paper will be bent, and with how much force, as it falls down into the output area.

Optionally, a stop is also used to prevent dynamic guide 210 from reaching an angle where its gravitational potential energy is at a minimum. From such an angle, the dynamic guide will be unstable to a force pushing it toward axis 316, since it will swing quickly in one direction or the other with only a small change in the direction of the force. If the decurler operated with dynamic guide 210 at such an unstable angle, its behavior might be unpredictable.

As shown in FIGS. 3 and 4, the surface 318 of dynamic guide 210 which pushes against the paper as it falls has a normal direction which is not in the plane of hinge 214, but oblique to it, as well as being oblique to the vertical. Optionally, the orientation of surface 318 is chosen so that the force exerted by dynamic guide 210 on the paper has a certain desired magnitude and direction, possibly changing as the paper falls, and as dynamic guide 210 swings toward the wall. Alternatively, the normal to surface 318 is in the plane of hinge 214, or is perpendicular to the vertical (i.e. surface 318 is vertical rather than oblique). A possible advantage to surface 318 being oblique is that initially, only the tip of the paper will just touch surface 318, and the paper will not exert enough force to move dynamic guide 210 significantly. As the paper falls, it will be decurled by the angle of surface 318. As the paper continues to fall, more of the paper will be in contact with surface 318, and the paper will exert enough force to push dynamic guide 210 toward the wall.

Optionally, dynamic guide 210 has an L-shaped cross-section, and the corner of the L is the first part of the dynamic guide to touch the paper as it falls. This configuration, with an edge that is not too sharp, has the potential advantage that the paper does get abraded as it falls. Optionally, other cross-sectional shapes without sharp edges are used. Another potential advantage of an L-shaped cross-section, or other shapes such as an I-beam cross-section, as opposed to a flat cross-section, is that it gives the dynamic guide additional stiffness, even if it is made very thin in order to keep its weight low. Alternatively, the dynamic guide has a flat cross-section, but has smooth enough edges so that they do not abrade, and is thick enough so that it is not too flexible.

FIGS. 1A and 1B show strip 124 hanging down from wall 122, between circular paths 112 and 116. As noted above, strip 124 is not in the same plane as suction arms 110 and 114 and guide 125, but is behind them or in front of them, from the point of view of FIGS. 1A-1D, and strip 124 does not interfere with suction arm 114 picking up paper 102 from suction arm 110. FIG. 1C shows paper 102 starting to go around circular path 116 after the leading portion of paper 102 has been released by suction arm 110 and picked up suction arm 114. Because the leading portion of paper 102 is below strip 124, the leading portion of paper 102 lifts up strip 124 as paper 102 starts to go around path 116. As paper 102 continues around path 116, strip 124 pushes down against paper 102, first against the leading or middle portion of the paper, and then against the trailing portion.

After the leading portion of paper 102 is released by suction arm 114, and paper 102 starts to fall toward output area 118, as shown in FIG. 1D, strip 124 continues to push down on trailing portion 130 of paper 102. Strip 124 thus overcomes any tendency of the paper to stick to guides 125. However, it should not be so heavy that it pulls the paper away from guides 125 prematurely or scratches images on the paper. It should be noted that for lightweight paper, static electricity on the paper can be effective to provide considerable attachment force, to guides 125 which the weight of the paper is too small to overcome.

If strip 124 does not extend across the whole width of the paper, but only across a middle portion of the width of the paper, then strip 124 will tend to bend paper 102 in the same way as dynamic guides 210 and 212, helping to decurl it even before suction arm 114 releases paper 102. After suction arm 114 releases paper 102, strip 124 helps to push trailing portion 130 of paper 102 against dynamic guides 210 and 212. In the case where the paper is very light weight, this prevents the paper from floating down slowly, which might result in the paper folding over as it falls, or deflecting to the side, due to air currents for example, and causing the paper to crease after it reaches output area 118, for example from the weight of additional sheets of paper that fall on top of it, or causing the paper to be improperly aligned in output area 118. Strip 124 optionally serves this purpose even if there is no decurler present, or if the decurler is of a kind known in the prior art, fixed or dynamic, rather than the kind shown in FIGS. 2, 3 and 4.

The length of strip 124 is preferably such that the strip is pushing against the paper when the paper is released and hits the stop. Optionally the end of the strip overlaps the trailing edge of the paper by about 2 cm at this time. The strip then pushes the trailing edge down, at the same time as the leading edge falls into the tray.

Optionally, the weight per length and the stiffness of strip 124, and the location of the bottom of strip 124 when it is hanging down, are chosen so that the force with which strip 124 pushes paper 102 against dynamic guides 210 and 212, and/or the force with which strip 124 pushes down paper 102 before suction arm 114 releases paper 102, is appropriate for decurling the paper used and for removing the paper from guide 125.

Optionally, strip 124 is light enough so that it is does not scratch, crease or tear the paper when it pushes against the paper, and it does not pull the paper off suction cups 114 or guide 125 before suction cups 114 are in position to release the paper. For example, strip 124 is 0.2 mm thick, 12 mm wide, and made of AISI 302 stainless spring steel, or tempered SAE 1070 tool steel. Alternatively, strip 124 is 0.1 mm thick, or 0.4 mm thick, or has another thickness, and/or strip 124 is 25 mm wide, or 6 mm wide, or has another width, and/or strip 124 is made of another kind of steel, or another metal, or plastic, or another material. Optionally, if strip 124 is made of a material of a different density or a different elastic modulus than spring steel or tool steel, then its thickness and/or width are adjusted from the values mentioned above so that strip 124 exerts approximately the same force on the paper. Alternatively, strip 124 exerts a greater force or a smaller force on the paper than it would with this composition and these dimensions, depending on the lightest paper for which it is designed.

Although this description and the claims refer sometimes to paper, the invention may also be used with any other printing media, and the claims cover the apparatus and the method when any printing media is used. The invention has been described in the context of the best mode for carrying it out. It should be understood that not all features shown in the drawings or described in the associated text may be present in an actual device, in accordance with some embodiments of the invention. Furthermore, variations on the method and apparatus shown are included within the scope of the invention, which is limited only by the claims. Also, features of one embodiment may be provided in conjunction with features of a different embodiment of the invention. As used herein, the terms "have", "include" and "comprise" or their conjugates mean "including but not limited to."

The invention claimed is:

1. A printer or copier for printing an image on a printing media, comprising:

a roller which imparts a curl to the printing media;

a transport mechanism which transports the printing media from the roller into a release area; and a decurler that decurls the printing media as the printing media is allowed to drop under influence of gravity into the release area, the decurler comprising:

i) at least one guide arm against which the printing media presses as it falls thereby deflecting the at least one guide arm upward against the influence of gravity; and ii) a hinge on which the guide arm is mounted, the hinge having an axis about which said guide arm pivots, the axis being oriented at an angle of between 0.25 degrees and 20 degrees from vertical, wherein a force that the guide arm exerts on the printing media is suitable for decurling the printing media.

2. A printer or copier according to claim 1, wherein the guide arm is mounted so that it remains in an equilibrium position to receive the printing media when there is no force on the guide arm, but the guide arm swings on the hinge away from the equilibrium position when the printing media presses vertically on the guide arm.

3. A printer or copier according to claim 1, and including a second guide arm, wherein the two guide arms exert substantially equal forces on the printing media on opposite edges thereof, thereby bending it.

4. A printer or copier according to claim 3, wherein the two guide arms are substantially mirror images of each other.

5. A printer or copier according to claim 1, wherein the force that the guide arm exerts on the printing media is exerting on a trailing portion of the printing media.

6. A printer or copier according to claim 1, wherein the guide arm includes a substantially flat contact surface, and the printing media presses against the contact surface when it presses against the guide arm.

7. A printer or copier according to claim 6, wherein the surface of the guide arm is smooth enough where the printing media presses against said surface so that the guide arm does not abrade the printing media.

8. A printer or copier according to claim 1, wherein the guide arm is at least twice as long along a longest axis thereof as it is wide across any axis perpendicular to the longest axis.

9. A printer or copier according to claim 8, wherein the guide arm is at least five times as long along the longest axis thereof as it is wide across any axis perpendicular to the longest axis.

10. A printer or copier according to claim 8, wherein the longest axis is oriented at an angle to the vertical, for any position of the guide arm as it swings on the hinge.

11. A printer or copier according to claim 10, wherein the angle of orientation of the long axis to the vertical is between 20 and 50 degrees, for any position of the guide arm as it swings on the hinge.

12. A printer or copier according to claim 8, wherein the guide arm has an L-shaped cross-section transverse to its longest axis.

13. A printer or copier according to claim 1, wherein the hinge comprises an upper socket, an upper pin which fits into the upper socket, a lower socket, and a lower pin which fits into the lower socket, and the upper and lower pins are substantially collinear, and oriented at the angle from the vertical at which the hinge is oriented.

14. A printer or copier according to claim 1, wherein the hinge comprises an upper socket, an upper pin which fits into the upper socket, a lower socket, and a lower pin which fits into the lower socket, and the upper and lower pins are oriented substantially vertically, and displaced laterally from each other by a distance such that a line passing through both pins is oriented at the angle from the vertical at which the hinge in oriented.

15. A printer or copier according to claim 1, wherein the angle from the vertical at which the hinge is oriented is less than or equal to 1 degree.

16. A printer or copier according to claim 1, wherein the angle from the vertical at which the hinge is oriented is between 1 and 5 degrees.

17. A printer or copier according to claim 1, wherein the angle from the vertical at which the hinge is oriented is greater than 5 degrees.

18. A printer or copier according to claim 1, wherein the guide arm is less than or equal to 40 mm long in its longest dimension.

19. A printer or copier according to claim 1, wherein the guide arm is between 40 mm and 120 mm long in its longest dimension.

20. A printer or copier according to claim 1, wherein the guide arm has a mass less than or equal to 1 gram.

21. A printer or copier according to claim 1, wherein the guide arm has a mass between 1 and 5 grams.

22. A printer or copier according to claim 1, wherein the guide arm has a mass between 5 and 20 grams.

23. A printer or copier according to claim 1, wherein the guide arm has a mass greater than 20 grams.

24. A printer or copier according to claim 1, wherein the guide arm can swing on its axis only over a limited range that does not include a position at which the guide arm has a local minimum in gravitational potential energy.

25. A printer or copier according to claim 1, wherein the sheet entering the decurler is curled in a direction perpendicular to the direction of bending.

26. A printer or copier according to claim 1, wherein the transport mechanism comprises at least one suction arm with a suction cup at its end, which at least one suction arm picks up the printing media from a pick-up position above the release area, swings the paper to a release position above the release area, and releases the paper at the release position so that it falls into the release area.

27. A printer or copier according to claim 1, and including a flexible strip which hangs down and pushes against a middle portion of the printing media as it moves in the feed direction, causing the printing media to bend along an axis substantially parallel to the direction of transport.

28. A method of decurling a sheet ejected from an imager comprising:

a) ejecting the sheet in a generally horizontal direction, while allowing it to fall vertically; and b) providing at least one guide arm mounted on a hinge, the guide arm being oriented at an angle of between 0.25 degrees and 20 degrees from vertical, c) positioning the guide arm so that the sheet falls on the at least one guide arm and by its weight causes the arm to rotate about the hinge, such that the printing media is bent along an axis substantially in said transport direction, the reaction force that the guide arm exerts on the printing media being suitable for decurling the printing media.

* * * * *